US011592014B2

(12) United States Patent
Smith et al.

(10) Patent No.: US 11,592,014 B2
(45) Date of Patent: Feb. 28, 2023

(54) METHOD AND SYSTEM FOR GAS COMPRESSOR CONTROL

(71) Applicant: AI ALPINE US BIDCO INC., Wilmington, DE (US)

(72) Inventors: Ryan Thomas Smith, Waukesha, WI (US); Eshang Saini, Milwaukee, WI (US); James Zurlo, Madison, WI (US)

(73) Assignee: AI ALPINE US BIDCO INC., Wilmington, DE (US)

( * ) Notice: Subject to any disclaimer, the term of this patent is extended or adjusted under 35 U.S.C. 154(b) by 808 days.

(21) Appl. No.: 15/909,673

(22) Filed: Mar. 1, 2018

(65) Prior Publication Data

US 2019/0271304 A1 Sep. 5, 2019

(51) Int. Cl.

*F04B 35/00* (2006.01)
*F04B 49/22* (2006.01)
*F04B 51/00* (2006.01)

(Continued)

(52) U.S. Cl.

CPC ..... *F04B 35/002* (2013.01); *F02B 63/06* (2013.01); *F02D 17/04* (2013.01); *F04B 17/05* (2013.01);

(Continued)

(58) Field of Classification Search

CPC ..... F04B 49/225; F04B 49/10; F04B 35/002; F04B 51/00; F04B 2203/0606; F04B 2203/0605; F04B 2203/0601; F04B 39/08; F04B 39/10; F04B 49/02; F04B 49/03; F04B 49/06; F04B 49/103; F04B 49/22; F04B 53/1085; F04B 2201/12–1203; F04B 2203/06; F04B 2203/0604; F04B 2203/0607; F04B 2207/01; F04B 2207/70; F04B 17/05; F04B 49/065; F04B 49/16; F02B 63/06; F02D 17/04; F02D 29/04; F02D 2200/0402

(Continued)

(56) References Cited

U.S. PATENT DOCUMENTS 3,415,441 A * 12/1968 Kehler ..... F04B 49/24 417/458
3,507,578 A * 4/1970 Bysarovich ..... F02D 29/00 417/53

(Continued)

OTHER PUBLICATIONS

Bourn, Gary & Mike Sutton, "Compression Optimization Improves Performance of Gathering Systems," American Oil & Gas Reporter, Oct. 2016, http://www.aogr.com/magazine/editors-choice/compression-optimization-improves-performance-of-gathering-systems, (accessed Feb. 22, 2018).

(Continued)

*Primary Examiner* — Peter J Bertheaud
(74) *Attorney, Agent, or Firm* — Fletcher Yoder, P.C.

(57) ABSTRACT

A method of controlling a gas compression system includes comparing an engine load of an engine of the gas compression system during operation to a load threshold and controlling a suction valve coupled to an intake of a reciprocating compressor. The suction valve is controlled based at least in part on the comparison of the engine load to the load threshold. Controlling the suction valve includes incrementing the suction valve toward a closed position to reduce flow of a gas into the intake when the engine load is greater than or equal to the load threshold.

22 Claims, 4 Drawing Sheets

(51) Int. Cl.

| | |
|---|---|
| ***F04B 49/10*** | (2006.01) |
| ***F02D 17/04*** | (2006.01) |
| ***F02B 63/06*** | (2006.01) |
| ***F04B 49/16*** | (2006.01) |
| ***F04B 17/05*** | (2006.01) |
| ***F04B 53/10*** | (2006.01) |
| ***F04B 49/06*** | (2006.01) |
| ***F02D 29/04*** | (2006.01) |

(52) U.S. Cl.
CPC ..... *F04B 49/065* (2013.01); *F04B 49/10* (2013.01); *F04B 49/16* (2013.01); *F04B 49/22* (2013.01); *F04B 49/225* (2013.01); *F04B 51/00* (2013.01); *F04B 53/1085* (2013.01); *F02D 29/04* (2013.01); *F02D 2200/0402* (2013.01); *F04B 2203/0601* (2013.01); *F04B 2203/0605* (2013.01); *F04B 2203/0606* (2013.01)

(58) Field of Classification Search
USPC ..... 417/446
See application file for complete search history.

(56) References Cited

U.S. PATENT DOCUMENTS

| | | | | |
|---|---|---|---|---|
| 4,353,220 | A * | 10/1982 | Curwen | H02K 33/02 417/214 |
| 5,594,665 | A * | 1/1997 | Walter | F04D 27/001 700/301 |
| 5,771,867 | A * | 6/1998 | Amstutz | F02B 37/225 123/568.21 |
| 8,430,646 | B2 | 4/2013 | Shade et al. | |
| 2005/0120730 | A1* | 6/2005 | Chen | F04B 49/16 62/228.5 |
| 2007/0295926 | A1* | 12/2007 | Kopecek | F16K 31/0655 251/129.16 |
| 2010/0040484 | A1* | 2/2010 | Shade | F04B 53/162 417/212 |
| 2017/0114748 | A1* | 4/2017 | Roth | F02B 1/14 |
| 2018/0023490 | A1* | 1/2018 | Beno | F04D 27/0284 701/102 |
| 2018/0106261 | A1* | 4/2018 | Zhang | G05B 23/0254 |

OTHER PUBLICATIONS

"EVCP—electrical Variable Volume Clearance Pocket," Ariel & Hoerbiger, http://www.gaselectricpartnership.com/eVCP_GMC pdf, (accessed Feb. 22, 2018).

"Operating Instructions: DE-3000+ Series Configurable Safety Shutdown and Control System with Graphing Capabilities, Form DE-3000+ IOI 8-15," altronic Hoerbiger Engine Solutions, pp. 1, 2, and 36-43, Aug. 2015, http://altronicinc.com/pdf/annunciators/de-3000_plus_ioi-8-15.pdf, (accessed Feb. 22, 2018).

* cited by examiner

METHOD AND SYSTEM FOR GAS COMPRESSOR CONTROL

BACKGROUND OF THE INVENTION

The subject matter disclosed herein relates to gas compression systems, and more specifically to a system and method for controlling a load on an engine that drives a reciprocating compressor of the gas compression system.

Gas compression systems may receive a gaseous fluid from an upstream source, increase the pressure of the gaseous fluid, and supply the gaseous fluid at the increased pressure to one or more downstream systems. Some gas compression systems utilize an engine to drive a gas compressor, such as a reciprocating compressor. The load on the engine may vary greatly during operation of the gas compression system. Some gas compression systems are located in remote areas, thereby increasing the time and cost associated with maintenance of components of the gas compression systems. Configuring the engine and gas compressor of a gas compression system to operate conservatively may reduce unscheduled maintenance events, but also reduce revenue and system efficiency. Configuring the engine and gas compressor of a gas compression system to operate aggressively may increase revenue and system efficiency during operation, but unscheduled maintenance events may increase costs, may occur more frequently, or both.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a method of controlling a gas compression system includes comparing an engine load of an engine of the gas compression system during operation to a load threshold and controlling a suction valve coupled to an intake of a reciprocating compressor. The suction valve is controlled based at least in part on the comparison of the engine load to the load threshold. Controlling the suction valve includes incrementing the suction valve toward a closed position to reduce flow of a gas into the intake when the engine load is greater than or equal to the load threshold.

In a second embodiment, a system includes a controller configured to control a suction valve coupled to an intake of a reciprocating compressor based at least in part on one or more engine parameters of an engine configured to drive the reciprocating compressor.

In a third embodiment, a system includes an engine and a suction valve. The engine is configured to drive a load that includes a reciprocating compressor. The suction valve is coupled to an intake of the reciprocating compressor. The suction valve is controlled based at least in part on a comparison of the load on the engine to a load threshold. The suction valve is controlled to increment toward a closed position to reduce flow of a gas into the intake when the load on the engine is greater than or equal to a load threshold.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
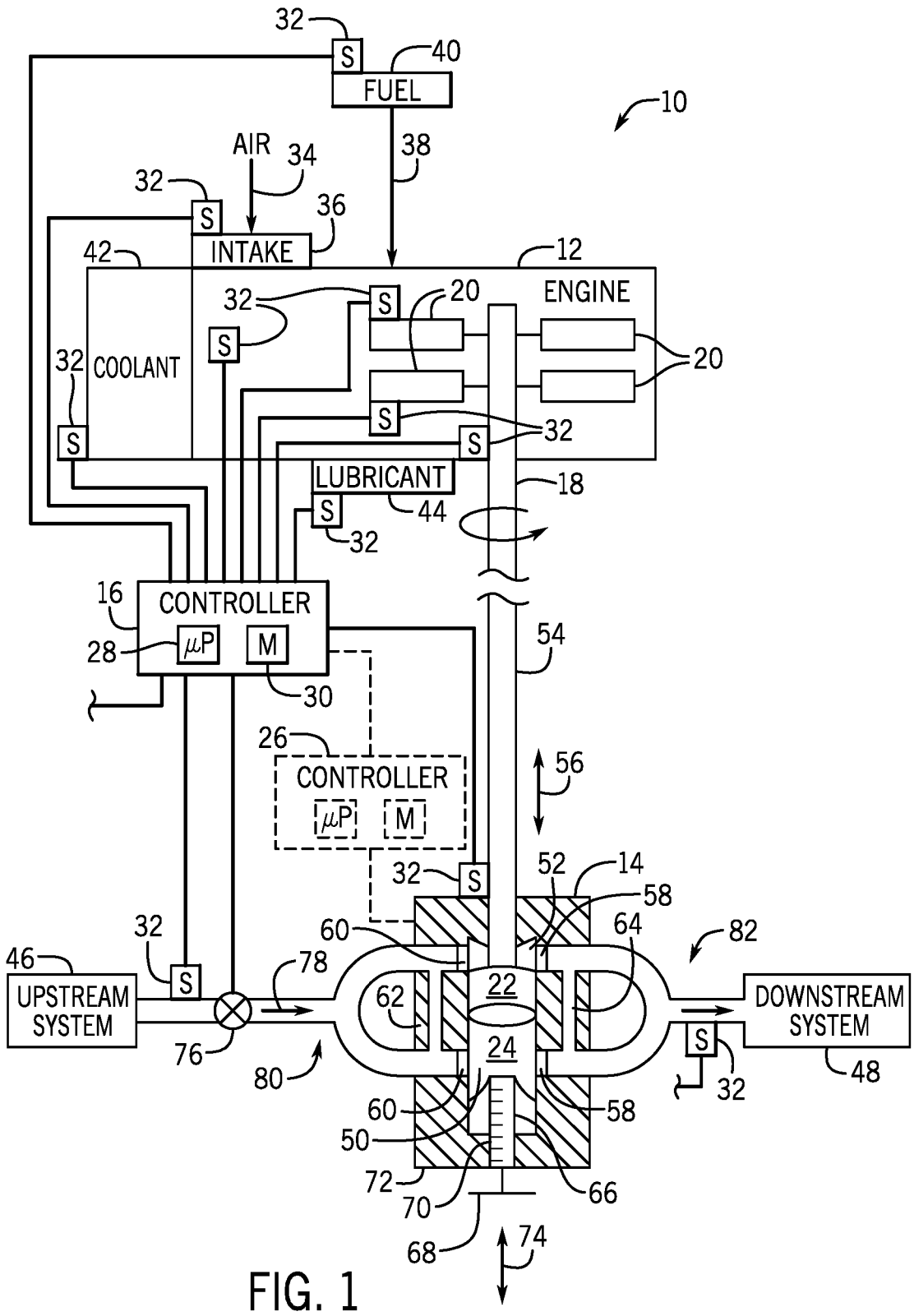
FIG. 1 is a schematic block diagram of an embodiment of a gas compression system with an engine, a gas compressor, and a controller.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Gas compression systems may receive gases (e.g., natural gas) from one or more upstream sources (e.g., wells, storage vessels) at a first pressure. The gas compression systems may pressurize the received gases, and provide them to downstream sources (e.g., pipelines, processing plants, storage vessels) at a second pressure that is greater than the first pressure. Some gas compression systems may be installed in remote locations (e.g., completed wells, pipeline junctions, pump stations), thereby reducing the convenience of servicing components of the gas compression systems.

Parameters of the gas compression system may be monitored during operation to facilitate control of the gas compression system, to alert an operator of the status of components of the gas compression system, or any combination thereof. An engine of the gas compression system may drive a gas compressor and other components (e.g., coolant system, control system) of the gas compression system. Embodiments of the gas compression system discussed herein may be controlled based at least in part on a monitored load on the engine. For example, a suction valve coupled to an intake of the gas compressor may be incremented closed to reduce a load on the engine when the monitored load nears a load threshold (e.g., rated load) for the engine. Additionally, or in the alternative, monitored parameters of the gas compression system may be compared to respective predetermined alarm thresholds to determine the operational status of components of the gas compression system. For example, the temperature of an engine coolant may be monitored to determine whether the engine may be overheating. A gas compression control system may raise an alarm when a monitored parameter is beyond a respective predetermined alarm threshold. As discussed herein, the gas compression control system may adjust the operation of components of the gas compression system in response to some triggered alarms, yet the gas compression control system may shut down components of the gas compression system in response to other triggered alarms. For example, the gas compression control system may control the gas compressor to reduce the load on the engine to a non-zero value in response to some triggered alarms, such as a high coolant temperature, a high intake manifold air temperature, a high lubricant temperature, or a knock alarm.

Although the gas compression control system may reduce the output and/or efficiency of the gas compression system by reducing the load on the engine, the reduced output is greater than the output (i.e., zero output) from a shutdown of the engine. Accordingly, the gas compression control system described herein may increase the output from the gas compression system between the time when an alarm is triggered and the gas compression system is serviced, relative to a gas compression control system that shuts down the gas compression system when an alarm is triggered. During the reduced-output operation, the gas compression control system may continue to monitor the parameters of the gas compression system to determine whether to further reduce the output or to shutdown the gas compression system. Moreover, in some embodiments, the gas compression control system may increase the output of the gas compression system if the monitored parameters leading to the prior triggered alarm improve and are within the respective alarm thresholds.

Turning to the drawings, FIG. 1 illustrates a schematic block diagram of an embodiment of a gas compression system 10 with an engine 12, a gas compressor 14, and a controller 16. The engine 12 may be coupled to and drive the gas compressor 14 by a crankshaft 18. The engine 12 may be an internal combustion engine that includes, but is not limited to a reciprocating internal combustion engine having one or more cylinders 20. In some embodiments, the engine 12 is a turbine engine or a rotary engine. In some embodiments, the engine 12 is an electric motor. The gas compressor 14 may be a reciprocating compressor with one or more pistons 22. The gas compressor 14 shown in FIG. 1 has one piston 22 shown for clarity, and it may be appreciated that the gas compressor 14 may include 2, 3, 4, 5, 6, 7, 8, 9, 10, or more pistons. Moreover, each piston 22 of a reciprocating gas compressor may be a double-acting piston, thereby enabling the piston 22 to compress a gas on both sides of the piston 22 as it reciprocates within its chamber 24.

The controller 16 of the gas compression system 10 may be coupled to the engine 12 and the gas compressor 14. Although FIG. 1 illustrates a common controller 16 coupled to both the engine 12 and the gas compressor 14, some embodiments of the gas compression system 10 may have the controller 16 (e.g., engine control unit (ECU)) coupled to the engine 12 to monitor and control the engine 12, and a second controller 26 (e.g., compressor control unit) coupled to the gas compressor 14 to monitor and control the gas compressor 14. The controller 16 (and the second controller 26, if present) may include a processor 28 and a memory 30. The memory 30 includes non-transitory, tangible, computer-readable medium storing instructions that are configured to cause the processor to perform specific actions, such as the methods discussed herein. The controller 16 may be coupled to one or more sensors 32 throughout the gas compression control system. Additionally, the controller 16 may be coupled to controls or valves of the engine 12 to control operation of the engine 12. For example, the controller 16 may control a throttle of the engine 12, the flow rates of air and fuel into the engine 12, and the direction of fluids (e.g., coolant, lubricant) through the engine 12. In some embodiments, the controller (e.g., controller 16, ECU, compressor control unit 26) may determine a desired engine speed (e.g., revolutions per minute (RPM)) of the engine 12, and control the engine 12 to operate at the desired engine speed. For example, the compressor control unit 26 may determine an engine RPM setpoint, provide the engine RPM setpoint to the ECU coupled to the engine 12, and the ECU may control the engine 12 to operate at the engine RPM setpoint. The controller 16 may be coupled to controls or valves of the gas compressor 14 to control operation of the gas compressor 14.

The engine 12 may receive air 34 through an intake manifold 36 for mixing with fuel 38 from a fuel source 40 for combustion within the one or more cylinders 20. That is, the air 34 received through the intake manifold 36 may be directed through the engine 12 to be combusted with the fuel 38 in the engine 12. The fuel 38 may include a liquid fuel (e.g., diesel, gasoline) or a gaseous fuel (e.g., methane, propane). A coolant system 42 (e.g., radiator) coupled to the engine 12 may facilitate temperature control (e.g., cooling) of the engine 12 during operation by directing a coolant through the engine 12. In some embodiments, the coolant system 42 may be coupled to the gas compressor 14 to facilitate temperature control of the gas compressor 14 during operation by directing a coolant through the gas compressor 14. A lubricant system 44 coupled to the engine 12 may direct a lubricant (e.g., oil) to moving components of the engine 12. In some embodiments, the sensors 32 of the gas compression system 10 may include, but are not limited to gas composition sensors (e.g., oxidant sensors, lambda sensors), flow sensors, temperature sensors (e.g., coolant temperature sensors, lubricant temperature sensors, intake manifold temperature sensors, compressor discharge temperature sensors), vibration sensors, knock detection sensors, compressor rod load sensors, pressure sensors (e.g., intake manifold pressure sensors), speed sensors (e.g., tachometers), microphones, or any combination thereof. In some embodiments, the controller 16 may utilize feedback from the sensors 32 of the gas compression system 10 to calculate gas compression system parameters (e.g., engine load, compressor rod load). For example, the compressor rod load may be determined based on a speed of the engine, measured pressures from the gas compressor, and known properties (e.g., mass, geometry) of components of the gas compressor.

The gas compressor 14 receives a gas from an upstream system 46, pressurizes the gas with the piston 22 in the chamber 24, and discharges the pressurized gas to a downstream system 48. As discussed above, the one or more pistons 22 of the gas compressor 14 may be double-acting pistons, thereby forming two sections 50, 52 of the chamber 24. The crankshaft 18 may drive one or more compressor rods 54 of the gas compressor 14. The gas compressor 14 may convert the rotational motion of the crankshaft 18 of the engine 12 to a reciprocating motion 56 of the one or more compressor rods 54, thereby enabling the one or more pistons 22 to reciprocate within the chamber 24. The gas compressor 14 may have a sensor 32 coupled to the one or more compressor rods 54, thereby enabling the controller 16 to determine a compressor rod load from feedback of the respective sensors 32 (e.g., load sensor).

The gas compressor 14 may include a series of valves coupled to the sections 50, 52 of the chamber 24. For example, the portion of the reciprocating gas compressor 14 shown in FIG. 1 includes two discharge valves 58 and two intake valves 60, one of each valve 58, 60 for each section 50, 52 of the chamber 24 with the double-acting piston 22. In other embodiments, the gas compressor 14 may include more than the two discharge valves 58 and more than the two intake valves 60, depending on how many pistons 22 (and, thus, how many corresponding chambers 24) are included in the gas compressor 14. Moreover, the quantity of valves (e.g., discharge valves 58, intake valves 60) for each piston 22 or chamber 24 may be based at least in part on the size of the piston 22 or chamber 24. That is, larger pistons 22 or chambers 24 may have more valves than smaller pistons 22 or chambers 24. As the piston 22 reciprocates away from the second section 52 of the chamber 24, a size (e.g., volume) of the second section 52 increases. The volume increase of the second section 52 of the chamber 24 causes a pressure differential (e.g., vacuum) between the fluid in the second section 52 of the chamber 24 and a suction manifold 62 coupled with the second section 52 at the intake valve 60. As the pressure differential exceeds a threshold pressure associated with the intake valve 60, the intake valve 60 opens, enabling fluid communication between the suction manifold 62 and the second section 52 of the chamber 24. After the intake valve 60 opens, the pressure differential also causes fluid (e.g., gas) to be drawn (e.g., sucked) into the second section 52 of the chamber 24 through the intake valve 60. Accordingly, the second section 52 fills with the fluid.

Further, as the piston 22 moves toward the first section 50 of the chamber 24 in FIG. 1, a volume of the first section 50 decreases. Thus, fluid (e.g., gas) within the first section 50 is compressed as the piston 22 moves toward the first section 50. After the fluid pressure within the first section 50 of the chamber 24 exceeds a threshold pressure of the discharge valve 58 associated with the first section 50, the discharge valve 58 opens. As the discharge valve 58 opens, the discharge valve 58 enables fluid communication between the first section 50 of the chamber 24 and a discharge manifold 64 coupled with the first section 50 at the discharge valve 58. Due to the pressure differential between the fluid in the first section 50 of the chamber 24 and in the discharge manifold 64, the compressed fluid within the first section 50 flows toward and into the discharge manifold 64. The compressed fluid is then delivered to the downstream system 48. The downstream system 48 may include an oil refinery, a gas pipeline, a chemical plant, a natural gas processing system, a refrigeration system, an air separation system, a biogas system, a fertilizer production system, a gas lift system, a hydrotreatment system, a polymer production system, an underground gas storage system, or any other suitable system or process.

As the piston 22 reciprocates away from the first section 50 of the chamber 24, the size (e.g., volume) of the first section 50 increase. The volume increase of the first section 50 of the chamber 24 causes a pressure differential (e.g., vacuum) between the fluid in the first section 50 and the suction manifold 62 coupled with the first section 50 at the intake valve 60. As the pressure differential exceeds the threshold pressure associated with the intake valve 60, the intake valve 60 opens, enabling fluid communication between the suction manifold 62 and the first section 50 of the chamber 24. After the intake valve 60 opens, the pressure differential also causes the fluid (e.g., gas) to be drawn (e.g., sucked into the first section 50 of the chamber 24 through the intake valve 60 of the first section 50. Accordingly, the first section 50 fills with the fluid (e.g., gas).

Further, as the piston 22 reciprocates toward the second section 52 of the chamber 24, the volume of the second section 52 decreases. Thus, fluid (e.g., gas) within the second section 52 is compressed as the piston 22 moves toward the second section 52. After the fluid pressure within the second section 52 exceeds a threshold pressure of the discharge valve 58, the discharge valve 58 opens. As the discharge valve 58 opens, the discharge valve 58 enables fluid communication between the second section 52 of the chamber 24 and the discharge manifold 64 coupled with the second section 52 at the discharge valve 58. Due to the pressure differential between the fluid (e.g., gas) in the second section 52 of the chamber 24 and in the discharge manifold 64, the compressed fluid within the second section 52 flows toward and into the discharge manifold 64. The compressed fluid is then exported elsewhere for other purposes, as described above.

In some embodiments, the gas compressor 14 may be a variable displacement compressor. Thus, a volume of the sections 50, 52 may be variable. To vary the displacement, a head 66 may extend the chamber 24 by adding a volume to the chamber 24. In some embodiments, the additional volume may be referred to as a variable volume clearance pocket (VVCP). The position of the head 66 may be adjusted to various set points using a control device 68 (e.g., handle) that controls an amount of clearance to adjust a maximum volume of the chamber 24 of the gas compressor 14. In some embodiments, rotation of the control device 68 may rotate a shaft 70 with a threaded-connection to a body 72 of the gas compressor 14, thereby enabling movement of the head 66 as shown by the arrows 74. Increasing the displacement of the chamber 24 may reduce the flow through the gas compressor 14 and reduce the load on the engine 12, while decreasing the displacement of the chamber 24 may increase the flow through the gas compressor and increase the load on the engine 12. An operator may adjust the position of the head 66 during a service period to a desired set point corresponding to an expected flow through the gas compressor 14 during operation of the gas compression system 10, an expected load on the engine 12 during operation of the gas compression system 10, or any combination thereof.

However, the gas flow through the gas compressor 14 and the load on the engine 12 may also be affected by the upstream system 46 and the downstream system 48. The pressure of a gas flow 78 from the upstream system 46 may vary greatly during operation of the gas compression system 10. For example, a well pressure may decrease as the gas flow is extracted, yet the well pressure may fluctuate rapidly up and down at times. While the pressure of the downstream system 48 may generally be steadier than the pressure of the gas flow 78 of the upstream system 46, the pressure of the downstream system 48 may also vary up and down during operation of the gas compression system 10. For example, the pressure of the downstream system 48 may vary with fluctuations in the supply of gas to the downstream system 48 from other gas compression systems 10 and fluctuations in the demand of gas by components of the downstream system 48. Accordingly, changes in the pressure at an intake 80 of the gas compressor 14 from the upstream system 46 affect the load on the engine 12. Additionally, changes in the temperature or pressure at a discharge 82 of the gas compressor 14 to the downstream system 48 affect the load on the engine 12.

A suction valve 76 may be coupled between the upstream system 46 and the intake 80 of the gas compressor 14. The suction valve 76 may include, but is not limited to a butterfly valve, a ball valve, a gate valve, or a globe valve. In some embodiments, the controller 16 may send a control signal to a current-to-pressure converter of the suction valve 76 that utilizes the control signal to move a diaphragm attached to the suction valve 76. The suction valve 76 may be automatically controlled by the controller 16 as described below. In some embodiments, the suction valve 76 may be automatically controlled during an engine startup and shutdown, but may be configured to enable some manual control during operation of the engine 12. In some embodiments, a common suction valve 76 may be fluidly coupled to each suction manifold 62 of the gas compressor 14. In some embodiments, each suction manifold 62 of the gas compressor 14 may be coupled to a separate suction valve 76. Each of the one or more suction valves 76 may be controlled to affect the gas flow 78 from the upstream system 46 to the gas compressor 14. As discussed herein, the controller 16 may control the one or more suction valves 76 during operation of the gas compression system 10 to control a load on the engine 12. Closing the suction valve 76 to decrease the gas flow 78 to the gas compressor 14 may decrease the load on the engine 12, yet opening the suction valve 76 to increase the flow of the gas to the gas compressor 14 may increase the load on the engine 12. As discussed herein, the term "closing" with respect to the suction valve 76 is used to describe incrementing (e.g., incrementally moving or incrementally adjusting) the suction valve 76 toward a closed (i.e., fully-closed) position with no gas flow 78 through the suction valve 76, and the term "opening" with respect to the suction valve 76 is used to describe incrementing (e.g., incrementally moving or incrementally adjusting) the suction valve 76 toward an opened (i.e., fully-opened) position with negligible restriction on the gas flow 78 through the suction valve 76. In some embodiments, the controller 16 may incrementally control (e.g., incrementally move, incrementally adjust) the suction valve 76 to reduce the gas flow 78 to the compressor 14 by any percentage between approximately 0 to 100%, approximately 1 to 95%, or between 5 to 75%.

Figure 2:
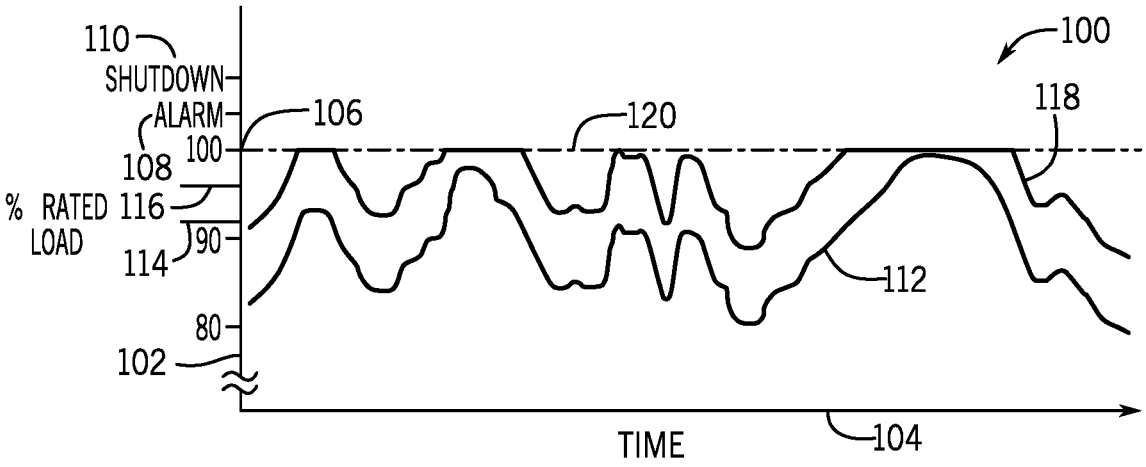
FIG. 2 is a chart illustrating a load on the engine of the gas compression system during operation with an embodiment of a load control described herein.

As discussed above, the load on the engine 12 may vary during operation of the gas compression system 10. FIG. 2 is a chart 100 illustrating loads on the engine 12 of the gas compression system 10 during operation. The y-axis 102 of the chart 100 depicts the load on the engine 12 as a percentage of a rated load for the engine 12, and the x-axis 104 of the chart 100 depicts the time that the engine 12 of the gas compression system 10 is operating. Each engine 12 may have a respective rated load 106 that corresponds to a peak load for which it may have been configured to operate at for prolonged periods. It may be appreciated that while a typical engine 12 may operate at loads 102 greater than the rated load 106 for brief periods, sustained operation above the rated load 106 may increase wear, fatigue, or likelihood of damage to components of the engine 12 to undesirable levels. Accordingly, the engine 12 may have an alarm load 108, a shutdown load 110, or any combination thereof that correspond to loads greater than the rated load 106. Operation of the engine 12 at or above the alarm load 108 may raise an alarm to notify an operator of the potentially undesirable operation, thereby enabling the operator to take a corrective action to reduce the load, to more closely monitor operation of the engine, or any combination thereof. In some embodiments, the controller 16 may record the alarm in an operation log stored in the memory 30. Operation of the engine 12 at or above the shutdown load 110 may instruct the operator to shutdown the engine 12. In some embodiments, the controller 16 may automatically shutdown the engine 12 if the load on the engine 12 exceeds the shutdown load 110.

The engine loading shown by the first load curve 112 illustrates operation of the engine 12 with the gas compression system 10 configured conservatively to avoid operation above the rated load 106. That is, the engine 12 may be configured to operate with an average load 114 much less than the rated load 106 to account for unpredictable load fluctuations that may otherwise cause the engine 12 to operate at or above the rated load 106. As discussed above, components (e.g., heads 66 of variable volume clearance pockets) of the gas compression system 10 may be configured during an installation or during a service period to have an expected average load on the engine 12 during operation. The gas compression system 10 may be configured conservatively due to the costs and downtime associated with service periods that may occur due to operation of the engine 12 at or above the alarm load 108 or the shutdown load 110. FIG. 2 illustrates an average first load 114 of the first load curve 112 of the engine 12.

The engine control method described herein may enable the controller 16 to control the gas compression system 10 to operate with an average second load 116 that is greater than the average first load 114. The engine loading shown by the second load curve 118 illustrates operation of the engine 12 with the gas compression system 10 wherein the controller 16 dynamically controls the load on the engine 12 as discussed below. The second load curve 118 generally has the same shape as the first load curve 112, except that the second load curve 118 has a greater average second load 116 and the durations with relatively higher engine loads do not exceed a load threshold 120. As described herein, the controller 16 may control the one or more suction valves 76 of the gas compression system 10 to control the load on the engine 12 to be less than or equal to the load threshold 120. FIG. 2 illustrates that the load threshold 120 is the rated load 106 of the engine 12. In some embodiments, the load threshold 120 may be another load value, such as any load value within approximately 10%, 5%, 3%, or 1% or less of the rated load 106 of the engine 12. For example, the load threshold 120 may be between 90% to 110% of the rated load 106, between 95% to 105% of the rated load, or between 100% to 105% of the rated load 106.

As described in detail below, the controller 16 may dynamically control the one or more suction valves 76 of the gas compression system 10 during operation based at least in part on a determined load on the engine 12, thereby reducing or eliminating operation of the engine 12 at loads greater than the load threshold 120. The second load curve 118 illustrates that control of the one or more suction valves 76 may reduce the variability of the load 102 on the engine 12 by effectively capping the load 102 at the load threshold 120. Accordingly, the control methods described herein enable the components of the gas compression system 10 to be configured less conservatively to increase the average load on the engine 12 without increasing operation of the engine at loads above the rated load 106.

Figure 3:
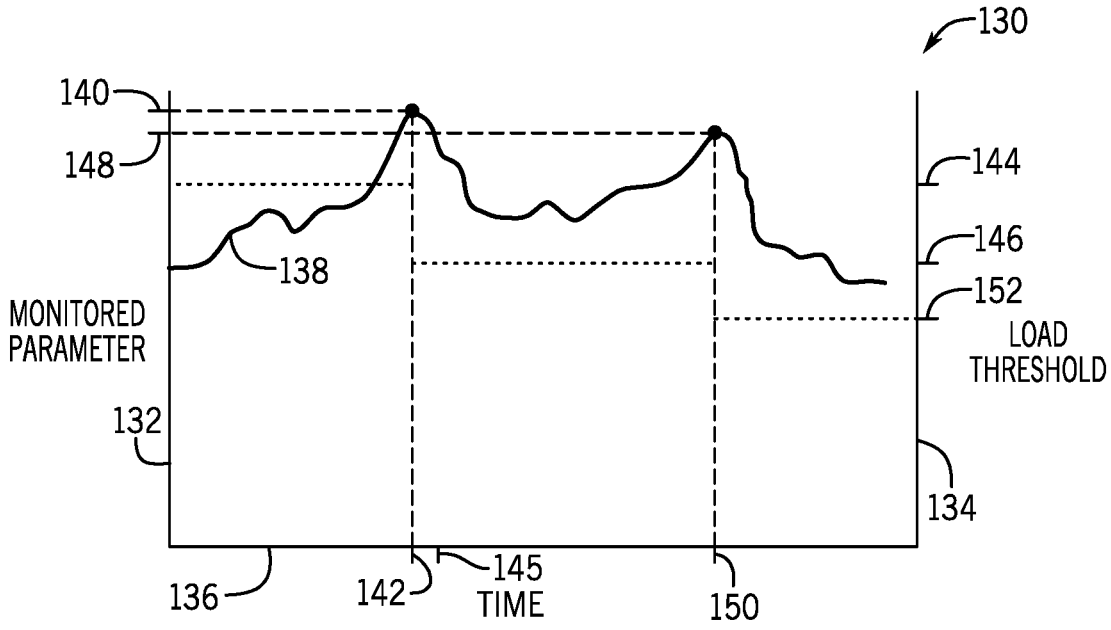
FIG. 3 is a chart illustrating a parameter and a load threshold for the engine of the gas compression system over time during operation.

In addition to or in the alternative to control of the suction valve 76 based at least in part on the load on the engine 12, the controller 16 may control the suction valve 76 based at least in part on monitored parameters of the gas compression system 10. FIG. 3 is a chart 130 illustrating a monitored parameter 132 over time 136 during operation of the gas compression system 10 and a load threshold 134 for the engine 12. The monitored parameter 132 (e.g., gas compression system parameter) may include, but is not limited to, engine knock, a temperature of a component or fluid, a pressure of a fluid, a detected peak audio level, a speed of a component, or any combination thereof. For example, the monitored parameter 132 may include compressor discharge temperature, compressor rod load, an engine knock frequency, an engine knock intensity, an engine coolant temperature, an engine lubricant temperature, an engine intake manifold temperature, an engine lubricant pressure, a speed of the engine, a speed of a component driven by the engine, a fuel quality for the engine, a fuel flow rate to the engine, an air flow rate to the engine, a detected peak audio level, an engine crank duration, a compressor coolant temperature, a compressor lubricant temperature, or any combination thereof. During operation of the gas compression system 10, the monitored parameter 132 (e.g., temperature) may vary over time 136.

The first portion of the parameter curve 138 illustrates the monitored parameter increasing to a first alarm threshold 140 at time 142. The controller 16 may raise an alarm for that monitored parameter 132 at time 142. In some embodiments, shutdown of the engine 12 at time 142 in response to the triggered alarm may prevent further increase in the monitored parameter 132, but also halts productive output from the engine 12 of the gas compression system 10. As discussed in detail below, the controller 16 may control the suction valve 76 to reduce a load on the engine 12 to a non-zero level in response to some triggered alarms corresponding to monitored parameters that may be affected by the load on the engine 12. For example, the gas compression system 10 may be configured to operate with a first engine load threshold 144 (e.g., rated load) until time 142. When the alarm for the monitored parameter 132 is triggered at time 142, the controller 16 determines whether a reduction in the load on the engine 12 to less than a second load threshold 146 may decrease the monitored parameter 132 without halting the productive output from the gas compression system 10. For example, if the controller 16 raises a coolant temperature alarm, the controller 16 may control the suction valve 76 to increment closed to reduce the load on the engine 12 to be less than or equal to the second load threshold 146. In some embodiments, the controller 16 may adjust the alarm threshold for the monitored parameter to a second alarm threshold 148 at a time 145 when the value for the monitored parameter 132 is less than the second alarm threshold 148.

In some embodiments, the controller 16 may continue to monitor the monitored parameter 132 while the engine 12 continues operation with the second load threshold 146. If the monitored parameter 132 increases to the second alarm threshold 148 at time 150, the controller 16 may raise a second alarm for that monitored parameter 132 and either shutdown the engine 12 or further control the suction valve 76 to reduce the load on the engine 12 to be less than a third load threshold 152 to attempt to decrease the monitored parameter 132 without halting the productive output from the gas compression system 10. The second alarm threshold 148 may be the same or less than the first alarm threshold 140. In some embodiments, the controller 16 may continue to monitor the monitored parameter 132 and control the suction valve 76 to reduce the load on the engine 12 in response to triggered alarms corresponding to parameters that may be affected by the load on the engine. For example, the controller 16 may control the suction valve 76 to reduce the load on the engine 12 two, three, four, five, six, seven, eight, nine, ten, or more times in response to triggered alarms corresponding to high coolant temperatures, high intake manifold temperatures, high lubricant temperatures, high compressor rod load, high compressor discharge temperature, or knocking. In some embodiments, the controller 16 may control the suction valve 76 to increase the load on the engine 12 if the monitored parameter 132 has responded positively to prior reductions in the load and the controller 16 determines that the conditions leading to the triggered alarm for the monitored parameter 132 may have passed. For example, the controller 16 may control the suction valve 76 to decrease the load on the engine 12 in response to a high coolant temperature alarm triggered during the heat of the day, and the controller 16 may control the suction valve 76 to increase the load on the engine 12 after several hours have elapsed such that the ambient temperature may be cooler.

Figure 4:
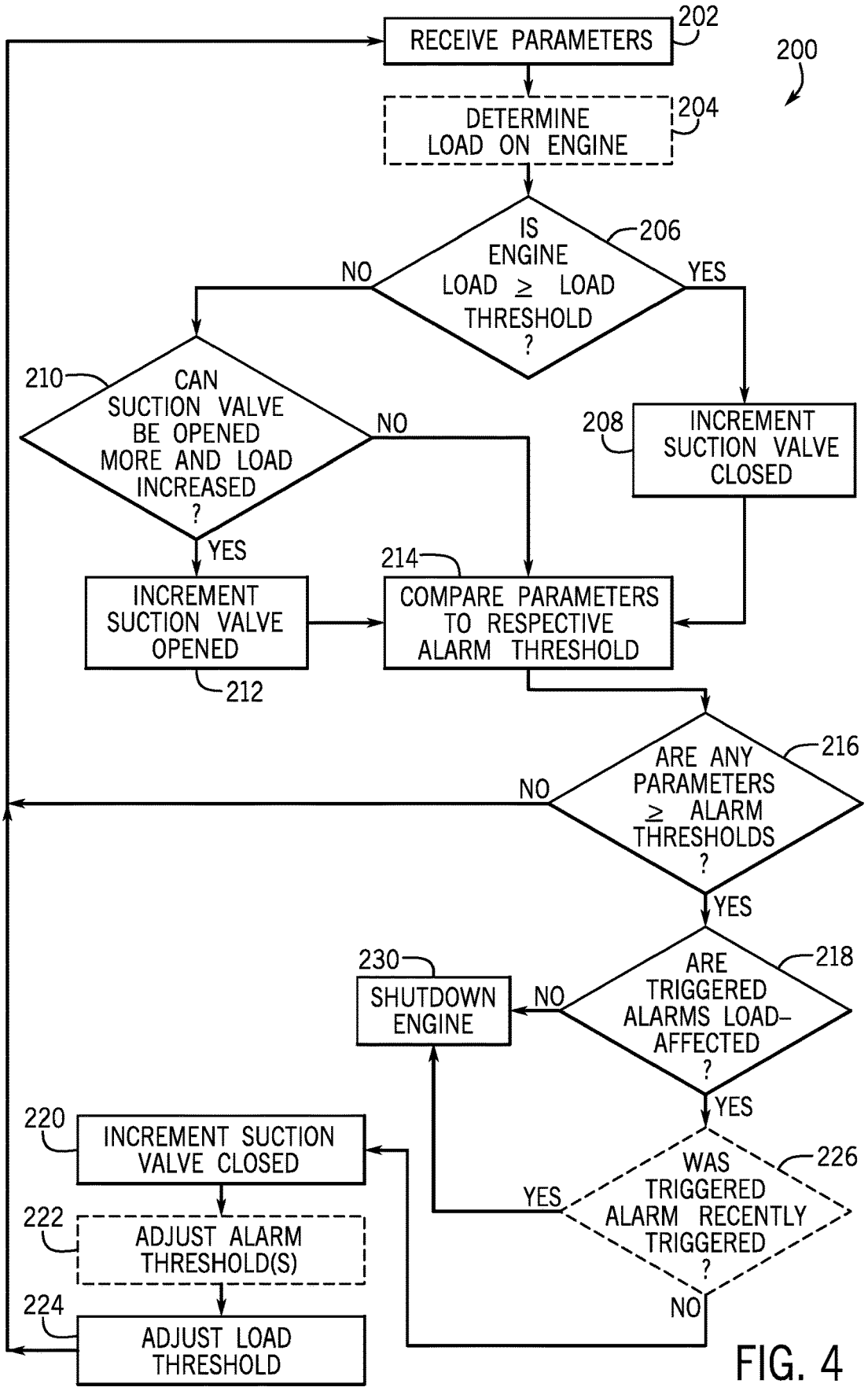
FIG. 4 is a flowchart illustrating an embodiment a method of control of the gas compression system.

FIG. 4 has a flowchart illustrating an embodiment a method 200 of control of the gas compression system 10 as described above with FIGS. 1-3. The controller 16 may execute instructions for the method 200 with the processor 28, and the instructions may be stored in the memory 30. The controller 16 that performs the method 200 may be an engine controller (e.g., ECU) coupled to the engine 12, a gas compressor controller coupled to the gas compressor 14, a controller of the gas compression system 10 coupled to the suction valve 76 and configured receive a load signal from an engine controller, or any combination thereof.

The controller 16 receives (block 202) engine parameters, which may include a load on the engine, among other parameters. In some embodiments in which the controller 16 does not receive the load on the engine, the controller 16 may determine (block 204) the load on the engine. For example, the controller 16 may determine (block 204) the load on the engine based at least in part on received engine parameters such as engine speed, fuel quality, fuel flow rate, engine intake manifold pressure, or any combination thereof. In some embodiments, the controller 16 receives (block 202) gas compression system parameters that include, but are not limited to the engine parameters. The controller 16 may then compare (node 206) the load on the engine to a load threshold. In some embodiments, the load threshold is a predetermined value, such as the rated load 106 of the engine, the alarm load 108, or the shutdown load 110 as discussed above with FIG. 2. In some embodiments, the load threshold is the load threshold 120 of FIG. 2 that may be loaded from the memory 30 of the controller 16 or set by an operator during a service period. In some embodiments, the load threshold used in the comparison at node 206 may be modified (block 224) for subsequent iterations of the method 200, as discussed below.

If the load is greater than or equal to the load threshold (YES from node 206), the controller 16 may control (block 208) the suction valve coupled to the gas compressor to increment closed. As discussed above, closing the suction valve reduces the gas flow to the gas compressor, thereby reducing the load on the engine by the gas compressor. If the load is less than the load threshold (NO from node 206), the controller 16 may determine (node 210) whether the suction valve may be opened more and whether the load may be increased. The controller 16 may control (block 212) the suction valve to increment open if the suction valve may be opened more and the load may be increased. To determine whether the suction valve may be opened more, the controller 16 may compare a position of the suction valve to a known valid range of positions for the suction valve, because the suction valve may not be opened beyond a maximum amount for the suction valve. To determine whether the load on the engine may be increased, the controller 16 may determine whether incrementing the suction valve open would likely cause the load to be greater than or equal to the load threshold on subsequent iterations of the method 200. For example, the controller 16 may increment the suction valve opened if the load on the engine is less than 95, 96, 97, 98, or 99% of the load threshold. In some embodiments, the controller 16 may determine whether the load on the engine may be increased based on whether the controller 16 recently adjusted the suction valve in response to a triggered load-affected alarm, as discussed below with node 226. For example, the controller 16 may not open the suction valve if the controller 16 recently closed the suction valve to attempt to lower the engine coolant temperature in response to a triggered coolant temperature alarm.

After the comparison at node 206, the controller 16 may compare (block 214) gas compression system parameters to respective alarm thresholds. In some embodiments, the controller 16 may compare (block 214) the gas compression system parameters to respective alarm thresholds directly after receiving the gas compression system parameters at block 202, thereby skipping block 204 and node 206. The gas compression system parameters may include, but are not limited to, compressor component load, compressor discharge temperature, engine knock, a coolant temperature, a lubricant temperature, a lubricant pressure, a detected peak audio level, a speed of the engine, an intake manifold temperature, a speed of the driven equipment (e.g., gas compressor), or any combination thereof. The compressor component load may include, but is not limited to, a compressor rod load calculated or determined for a compressor rod, a load on a bearing, or a load (e.g., compressive, tensile) on another component of the gas compressor.

At node 216, the controller 16 determines if any gas compression system parameters are greater than or equal to the respective alarm thresholds. For example, the controller 16 may detect knock by monitoring vibrations within one or more frequency ranges for the engine and during a predetermined window of time of the engine cycle when engine knock may occur. If the controller 16 detects engine knock, the controller 16 may adjust (e.g., retard) spark timing to attempt to reduce the engine knock. If engine knock persists for multiple (e.g., 2, 5, 10, 25, 60, or more) engine cycles despite the prior adjustments to the spark timing, then the controller 16 may trigger an engine knock alarm. The controller 16 may trigger an appropriate temperature alarm if the coolant temperature exceeds a coolant alarm temperature, the lubricant temperature exceeds a lubricant alarm temperature, or the intake manifold temperature exceeds an intake manifold alarm temperature. The controller 16 may trigger a lubricant pressure alarm if the lubricant pressure exceeds a lubricant alarm pressure. The controller 16 may trigger a knock absolute threshold alarm if a detected peak audio level exceeds an audio alarm level or a detected peak vibration level exceeds a vibration alarm level. For example, the controller 16 would trigger the knock absolute threshold alarm upon detecting a loud noise or vibration caused by a break in a seal, valve, shaft, or moving component of the engine. The controller 16 may trigger an engine overspeed alarm if the engine speed exceeds an engine speed alarm value. The controller 16 may trigger a component overspeed alarm if the speed of the driven equipment exceeds an equipment speed alarm value.

If the controller 16 determines at node 216 that no gas compression system parameters are greater than or equal to the respective alarm thresholds, then the controller 16 may return to block 202 or block 214 to begin the next iteration of the method 200 at the end of a sample period. In some embodiments, the sample period for each iteration of the method 200 is 1, 15, 30, 60 seconds or more. If the controller 16 determines at node 216 that a gas compression system parameter is greater than or equal to the respective alarm thresholds and an alarm is triggered, then the controller determines at node 218 if the one or more triggered alarms are load-affected. If the triggered alarm is not a load affected alarm, then the controller 16 controls (block 230) the engine to shutdown or communicates a shutdown signal to an operator or an engine controller coupled to the engine. Upon shutdown of the engine, the controller 16 may stop the method 200 until the engine is restarted, such as during a service period.

As discussed herein, a load-affected alarm is an alarm based on monitored gas compression system parameters that may be affected by the load on the engine, such that a reduction of the load on the engine is likely to cause the monitored gas compression system parameters to decrease to be less than the respective alarm thresholds without causing or increasing damage to the engine. As discussed herein, the load-affected alarms are the compressor load alarm (e.g., compressor rod load alarm), compressor discharge temperature alarm, engine knock alarm, the coolant temperature alarm of the engine or the compressor, the intake manifold temperature alarm, and the lubricant temperature alarm of the engine or the compressor. Accordingly, if the one or more triggered alarms are load-affected alarms, then controller 16 increments (block 220) the suction valve closed to reduce the load on the engine. In some embodiments, the controller 16 may adjust (block 222) alarm thresholds when the suction valve is incremented closed. For example, in reference to FIG. 3, the alarm threshold is adjusted from the first alarm threshold 140 to the second alarm threshold 148 at time 145. As a further example, a coolant temperature alarm threshold may be adjusted from a first alarm threshold of 100° C. to a second alarm threshold of 95° C. Adjustments to the alarm thresholds may enable the controller 16 to reduce or eliminate wear or other costs associated with the engine if the monitored gas compression system parameter does not respond as expected to the reduced load on the engine. The controller 16 adjusts (block 224) the load threshold for the engine when the suction valve is incremented closed. For example, in reference to FIG. 3, the load threshold is adjusted from the first engine load threshold 144 to the second engine load threshold 146 at time 142. In some embodiments, the adjusted load threshold from block 224 is the load threshold that the controller 16 utilizes in the comparison at node 206 in subsequent iterations of the method 200. Accordingly, the controller 16 may iteratively execute the method 200 to incrementally open or close the suction valve to dynamically control the load on the engine during operation.

In some embodiments, the controller 16 may determine (node 226) whether the triggered alarm was recently triggered before incrementing (block 220) the suction valve closed to reduce the load on the engine in response to a triggered load-affected alarm. If the controller 16 determines that the triggered alarm was recently triggered, then the controller 16 controls (block 230) the engine to shutdown or communicates a shutdown signal to an operator or an engine controller coupled to the engine. Accordingly, the node 226 enables a load-affected alarm to be triggered once without shutting down the engine so that the controller 16 has sufficient time to evaluate if an attempt to reduce the monitored gas compression system parameter to be less than the respective alarm threshold is effective. In some embodiments, the controller 16 may start a shutdown timer (e.g., 5, 15, 30, 60, 300 seconds or more) when a load-affected alarm is triggered. If the conditions that would trigger the load-affected alarm persist after expiration of the shutdown timer, then the controller may control (block 230) the engine to shutdown. It may be appreciated that a reduced output from the gas compression system for a time due to a triggered load-affected alarm is greater than no output from a gas compression system that is shut down due to any triggered alarm. For node 226, the controller 16 may consider the triggered load-affected alarm to be recently triggered if the alarm was triggered in the past 10, 15, 30, 60, 100, or 300 seconds or less.

Figure 5:
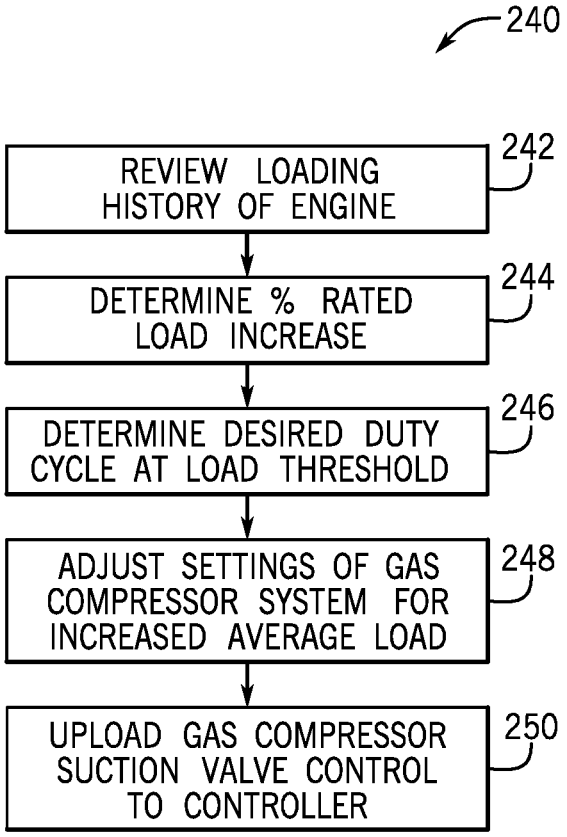
FIG. 5 is a flowchart illustrating an embodiment of implementing the load control of the gas compression system.

FIG. 5 is a flowchart 240 illustrating an embodiment for implementing the load control method 200 described above with FIG. 4. An operator may review (block 242) a loading history of the engine. For example, the operator may identify the average load on the engine, a median load on the engine, a maximum load on the engine, and a variability in the load on the engine. The operator may determine (block 244) a desired percentage of the rated load increase for the average load on the engine. Additionally, the operator may determine (block 246) a desired duty cycle for operation of the engine at the load threshold. For example, in reference to FIG. 2, the operator may review the first load curve 112 and determine to increase the percentage of the rated load from about 92% of the rated load to about 95% of the rated load. Shifting the first load curve 112 up along the y-axis 102 so that the first average load 114 (e.g., about 92%) is equal to the second average load 116 (e.g., about 95%) would cause portions of the shifted curve to be greater than the load threshold 120. Accordingly, the second load curve 118 caps the load at the load threshold 120. The operator may determine (block 246) the desired duty cycle of operating the engine at the load threshold. Moreover, the operator may consider the capabilities of the suction valve and the effects of closing the suction valve on components of the upstream system when determining the desired duty cycle of operating the engine at the load threshold. For example, continued operation of the gas compression system with the suction valve partially closed to maintain the load on the engine at the load threshold may decrease the efficiency of the gas compression system and/or decrease the flow of gas through the gas compression system.

The operator may adjust (block 248) components of the gas compression system to increase the average load on the engine by the gas compressor during operation. For example, the operator may adjust the heads of variable volume clearance pockets. When the components of the gas compressor are set, the operator uploads (block 250) the load control method to the controller coupled to the suction valve. As described above, the load control method enables the controller to maintain control of the load on the engine to be less than the load threshold.

Technical effects of the invention include increased average load on the engine of a gas compression system, as well as reduced frequency and duration of shutdowns of the engine of the gas compression system. Control of the suction valve to the gas compressor based at least in part on the load on the engine may enable the gas compressor to be configured for higher loads during service periods, and dynamically adjusted during operation to reduce or eliminate operation of the engine at loads greater than a load threshold. Additionally, the suction valve may be controlled to enable operation of the engine and the gas compression system with a reduced output in response to a triggered load-affected alarm, thereby providing greater output from the gas compression system than if the engine was shut down in response to the triggered load-affected alarm.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method of controlling a gas compression system, comprising:

adjusting, during an installation or service period while not operating the gas compression system, a variable volume clearance pocket (VVCP) of a reciprocating compressor to a setpoint to adjust an expected average load on an internal combustion engine drivingly coupled to the reciprocating compressor of the gas compression system during a subsequent operation, wherein the VVCP comprises a head extending into a chamber;

comparing, during the subsequent operation of the gas compression system while the VVCP is disposed at the setpoint, an engine load of the internal combustion engine drivingly coupled to the reciprocating compressor of the gas compression system to a load threshold; and adjusting, during the subsequent operation of the gas compression system while the VVCP is disposed at the setpoint, the engine load by controlling a suction valve coupled to an intake of the reciprocating compressor based at least in part on the comparison of the engine load to the load threshold, wherein adjusting the engine load comprises:

reducing the engine load by moving the suction valve toward a closed position to reduce flow of a gas into the intake when the engine load is greater than or equal to the load threshold to protect the internal combustion engine against undesirable wear, fatigue or damage associated with sustained operation above the load threshold.

2. The method of claim 1, wherein adjusting the engine load comprises increasing the engine load by moving the suction valve toward an open position to increase flow of the gas into the intake to increase output of the reciprocating compressor when the engine load is less than the load threshold.

3. The method of claim 2, wherein increasing the engine load by moving the suction valve comprises moving the suction valve toward the open position when the engine load is less than 95% of the load threshold.

4. The method of claim 1, comprising determining the engine load based at least in part on a speed of the internal combustion engine, an engine intake manifold pressure, an engine intake manifold temperature, and a fuel quality.

5. The method of claim 1, comprising:

receiving a plurality of gas compression system parameters during the subsequent operation of the internal combustion engine;

comparing each gas compression system parameter of the plurality of gas compression system parameters to a respective alarm threshold; and triggering an alarm for each gas compression system parameter that exceeds a respective alarm threshold of a plurality of alarm thresholds.

6. The method of claim 5, comprising shutting down the internal combustion engine if the triggered alarm is not a load-affected alarm.

7. The method of claim 5, comprising reducing the engine load by moving the suction valve toward the closed position to reduce flow of the gas into the intake if the triggered alarm is a load-affected alarm.

8. The method of claim 7, comprising adjusting the respective alarm threshold of the plurality of alarm thresholds that corresponds to the triggered alarm.

9. The method of claim 7, wherein the load-affected alarm comprises a compressor load alarm, a compressor discharge temperature alarm, an engine knock alarm, a coolant temperature alarm, an intake manifold temperature alarm, a lubricant temperature alarm, or any combination thereof.

10. A system comprising:

a controller programmed with a load control at least partially based on an adjustment of, during an installation or service period while not operating a gas compression system having a reciprocating compressor drivingly coupled to an internal combustion engine, a variable volume clearance pocket (VVCP) of the reciprocating compressor to a setpoint to adjust an expected average load on the internal combustion engine during a subsequent operation;

wherein the load control of the controller is programmed to, during the subsequent operation of the gas compression system while the VVCP is disposed at the setpoint, adjust an engine load on the internal combustion engine based at least in part on one or more engine parameters indicating an overload on the internal combustion engine by controlling a suction valve coupled to an intake of the reciprocating compressor, wherein the load control of the controller is programmed to reduce the engine load by moving the suction valve toward a closed position to reduce a gas flow into the intake to protect the internal combustion engine against undesirable wear, fatigue or damage associated with sustained operation at the overload, wherein the VVCP comprises a head extending into a chamber.

11. The system of claim 10, wherein the one or more engine parameters comprise the engine load, the controller is programmed to adjust the engine load based at least in part on a comparison of the engine load to a load threshold by controlling the suction valve, and the controller is programmed to reduce the engine load by moving the suction valve toward the closed position to reduce the gas flow into the intake when the engine load is greater than or equal to the load threshold of the engine to protect the internal combustion engine against undesirable wear, fatigue or damage associated with sustained operation at the overload above the load threshold.

12. The system of claim 11, wherein the one or more engine parameters comprise a speed of the engine, an engine intake manifold pressure, an engine intake manifold temperature, and a fuel quality, wherein the controller is programmed to determine the engine load based at least in part on the speed of the internal combustion engine, the engine intake manifold pressure, the engine intake manifold temperature, and the fuel quality.

13. The system of claim 10, wherein the one or more engine parameters comprise one or more load-affected parameters including a coolant temperature, a lubricant temperature, an intake manifold temperature, or an engine knock, or any combination thereof, and the controller is programmed to control the suction valve to reduce the engine load on the internal combustion engine if:

the coolant temperature is greater than a coolant temperature alarm threshold;

the lubricant temperature is greater than a lubricant temperature alarm threshold;

the intake manifold temperature is greater than an engine intake manifold temperature alarm threshold; or the engine knock persists despite a prior adjustment to a spark timing for the internal combustion engine.

14. The system of claim 10, comprising the internal combustion engine coupled to the controller, wherein the controller is programmed to control operation of the internal combustion engine.

15. The system of claim 10, comprising the suction valve coupled to the controller to control the gas flow into the intake of the reciprocating compressor.

16. The system of claim 10, wherein the load control of the controller is programmed to reduce the engine load by moving the suction valve toward the closed position as an attempt to eliminate the overload, and the controller is programmed to shut down the internal combustion engine if the overload exists after the attempt.

17. The system of claim 16, wherein the one or more engine parameters indicating the overload comprise one or more load-affected alarms, the controller is programmed to start a shutdown timer if conditions trigger at least one alarm of the one or more load-affected alarms, and the controller is programmed to shut down the internal combustion engine if the conditions triggering the at least one alarm persist after expiration of the shutdown timer.

18. A system comprising:

a reciprocating compressor comprising a variable volume clearance pocket (VVCP), wherein the VVCP comprises a head extending into a chamber;

an internal combustion engine drivingly coupled to the reciprocating compressor, wherein, during an installation or service period while not operating the reciprocating compressor, the VVCP is adjustable to a setpoint to control an expected average load on the internal combustion engine during a subsequent operation; and a suction valve coupled to an intake of the reciprocating compressor, wherein the suction valve is controlled via a load control, during the subsequent operation of the reciprocating compressor while the VVCP is disposed at the setpoint, to adjust an engine load on the internal combustion engine based at least in part on a comparison of the engine load to a load threshold, wherein the suction valve is controlled via the load control to reduce the engine load by moving toward a closed position to reduce flow of a gas into the intake when the engine load is greater than or equal to the load threshold to protect the internal combustion engine against undesirable wear, fatigue or damage associated with sustained operation above the load threshold.

19. The system of claim 18, comprising:

a plurality of sensors coupled to the internal combustion engine; and a controller coupled to the internal combustion engine, the suction valve, and the plurality of sensors, wherein the controller is programmed to determine the load on the internal combustion engine based at least in part on engine parameters received from the plurality of sensors, the controller is programmed to compare the engine load to the load threshold, and the controller is programmed to control the suction valve to adjust the engine load based at least in part on the comparison of the engine load to the load threshold.

20. The system of claim 19, wherein the internal combustion engine comprises:

a coolant system coupled to the internal combustion engine and configured to direct a coolant through the internal combustion engine during operation, wherein the plurality of sensors comprises a coolant temperature sensor of the coolant system;

a lubricant system coupled to the internal combustion engine and configured to direct a lubricant through the internal combustion engine during operation, wherein the plurality of sensors comprises a lubricant temperature sensor of the lubricant system; and an intake manifold coupled to the internal combustion engine and configured to receive air for combustion in the internal combustion engine during operation, wherein the plurality of sensors comprises an intake manifold temperature sensor of the intake manifold.

21. The system of claim 20, wherein the controller is programmed to:

trigger a load-affected alarm if a coolant temperature detected by the coolant temperature sensor is greater than a coolant temperature alarm, if a lubricant temperature detected by the lubricant temperature sensor is greater than a lubricant temperature alarm, or if an intake manifold temperature detected by the intake manifold temperature sensor is greater than an intake manifold temperature alarm; and control the suction valve to move toward the closed position in response to a triggered load-affected alarm.

22. The system of claim 18, wherein, during the installation or service period while not operating the reciprocating compressor, the VVCP is adjustable to the setpoint to increase the average load on the internal combustion engine, and the suction valve is dynamically controlled during the subsequent operation of the internal combustion engine to adjust the engine load on the internal combustion engine.

* * * * *